US008556575B2

(12) United States Patent
Knapp et al.

(10) Patent No.: US 8,556,575 B2
(45) Date of Patent: Oct. 15, 2013

(54) BLADE OUTER SEAL FOR A GAS TURBINE ENGINE

(75) Inventors: James N. Knapp, Sanford, ME (US); Paul M. Lutjen, Kennebunkport, ME (US); Susan M. Tholen, Kennebunk, ME (US)

(73) Assignee: United Technologies Corporation, Hartford, CT (US)

( * ) Notice: Subject to any disclaimer, the term of this patent is extended or adjusted under 35 U.S.C. 154(b) by 753 days.

(21) Appl. No.: 12/732,958

(22) Filed: Mar. 26, 2010

(65) Prior Publication Data

US 2011/0236188 A1 Sep. 29, 2011

(51) Int. Cl.
*F01D 9/04* (2006.01)
*F01D 25/12* (2006.01)

(52) U.S. Cl.
USPC ..... 415/115; 415/116; 415/173.1

(58) Field of Classification Search
USPC ..... 415/115, 116, 173.1, 173.2, 173.3, 415/173.7, 174.1, 174.2
See application file for complete search history.

(56) References Cited

U.S. PATENT DOCUMENTS

| | | | | |
|---|---|---|---|---|
| 3,844,343 | A * | 10/1974 | Burggraf | 165/109.1 |
| 3,876,330 | A | 4/1975 | Pearson et al. | |
| 4,497,610 | A * | 2/1985 | Richardson et al. | 415/116 |
| 4,949,545 | A | 8/1990 | Shekleton | |
| 5,064,343 | A | 11/1991 | Mills | |
| 5,165,847 | A | 11/1992 | Proctor et al. | |
| 5,169,287 | A | 12/1992 | Proctor et al. | |
| 5,584,651 | A * | 12/1996 | Pietraszkiewicz et al. | 415/115 |
| 5,609,469 | A | 3/1997 | Worley et al. | |
| 6,155,778 | A * | 12/2000 | Lee et al. | 415/116 |
| 6,302,642 | B1 * | 10/2001 | Nagler et al. | 415/116 |
| 6,340,285 | B1 * | 1/2002 | Gonyou et al. | 415/116 |
| 6,742,783 | B1 * | 6/2004 | Lawer et al. | 277/416 |
| 7,137,776 | B2 | 11/2006 | Draper et al. | |
| 7,201,559 | B2 * | 4/2007 | Gendraud et al. | 415/173.1 |
| 7,306,424 | B2 | 12/2007 | Romanov et al. | |
| 7,520,715 | B2 * | 4/2009 | Durocher et al. | 415/116 |
| 7,553,128 | B2 | 6/2009 | Abdel-Messeh et al. | |
| 2004/0047725 | A1 | 3/2004 | Tomita et al. | |
| 2007/0020088 | A1 * | 1/2007 | Durocher et al. | 415/115 |
| 2008/0127491 | A1 | 6/2008 | Lee et al. | |
| 2008/0131263 | A1 | 6/2008 | Lee et al. | |
| 2008/0211192 | A1 | 9/2008 | Pietraszkiewicz et al. | |
| 2009/0169368 | A1 | 7/2009 | Schlichting et al. | |
| 2011/0236188 | A1 * | 9/2011 | Knapp et al. | 415/173.1 |

FOREIGN PATENT DOCUMENTS

JP 63239301 A * 10/1988

OTHER PUBLICATIONS

EP Search Report for EP 11159900.7, dated Apr. 17, 2012.

* cited by examiner

*Primary Examiner* — Edward Look
*Assistant Examiner* — Christopher R Legendre
(74) *Attorney, Agent, or Firm* — O'Shea Getz P.C.

(57) ABSTRACT

A blade outer air seal for a gas turbine engine is provided. The blade outer air seal includes a body having an outer radial surface, an inner radial surface, and a plurality of cooling air apertures. The body extends between a forward edge and an aft edge. The inner radial surface includes at least one first seal section, at least one second seal section, and a riser extending radially between the first seal section and the second seal section. Each of the plurality of cooling air apertures extends between the outer radial surface and the riser, and each cooling air aperture has an exit configured to direct cooling air substantially parallel to the second seal section of the inner radial surface.

15 Claims, 4 Drawing Sheets

BLADE OUTER SEAL FOR A GAS TURBINE ENGINE

BACKGROUND OF THE INVENTION

1. Technical Field

This disclosure relates generally to a blade outer air seal for a gas turbine engine and, more particularly, to a cooled blade outer air seal.

2. Background Information

A typical section of a gas turbine engine includes a blade outer air seal (or shroud) disposed between the blades of a rotor stage and an engine case. During operation of the engine, the blade outer air seal (BOAS) is typically subject to high temperatures induced by extremely high core gas temperatures. To maintain part integrity, BOAS are often cooled with air bled from a compressor section of the engine. In some instances, the BOAS are internally cooled by directing cooling air through a plurality of internal passages, and exiting that cooling air in a manner such that it is injected substantially radially into the core gas path. This type of cooling is useful in some applications, but is relatively inefficient in others. In other instances, the cooling apertures are oriented at a shallow angle relative to the core gas path surface of the BOAS, and include a diffuser region contiguous with the core gas path. The angled orientation and diffuser portion facilitate the formation of a protective layer of cooling air traveling along the core gas path surface of the BOAS. If the blade tips engage (i.e., "rub") the BOAS, however, the result of this engagement can compromise the ability of the aforesaid cooling apertures to adequately cool the BOAS.

SUMMARY OF THE DISCLOSURE

According to a first aspect of the invention, a blade outer air seal for a gas turbine engine is provided. The blade outer air seal includes a body having an outer radial surface, an inner radial surface, and a plurality of cooling air apertures. The body extends between a forward edge and an aft edge. The inner radial surface includes at least one first seal section, at least one second seal section, and a riser extending radially between the first seal section and the second seal section. Each of the plurality of cooling air apertures extends between the outer radial surface and the riser, and each cooling air aperture has an exit configured to direct cooling air substantially parallel to the second seal section of the inner radial surface.

According to a second aspect of the invention, a gas turbine engine is provided that includes an engine case, at least one rotor stage, and a blade outer air seal. The rotor stage has a plurality of rotor blades. The blade outer air seal is disposed between the engine case and the blades. The blade outer air seal includes a body having an outer radial surface, an inner radial surface, and a plurality of cooling air apertures. The body extends between a forward edge and an aft edge. The inner radial surface includes at least one first seal section, at least one second seal section, and a riser extending radially between the first seal section and the second seal section. Each of the plurality of cooling air apertures extends between the outer radial surface and the riser, and each cooling air aperture has an exit configured to direct cooling air substantially parallel to the second seal section of the inner radial surface.

The foregoing features and advantages and the operation of the invention will become more apparent in light of the following description and the accompanying drawings.

DETAILED DESCRIPTION OF THE INVENTION

Figure 1:
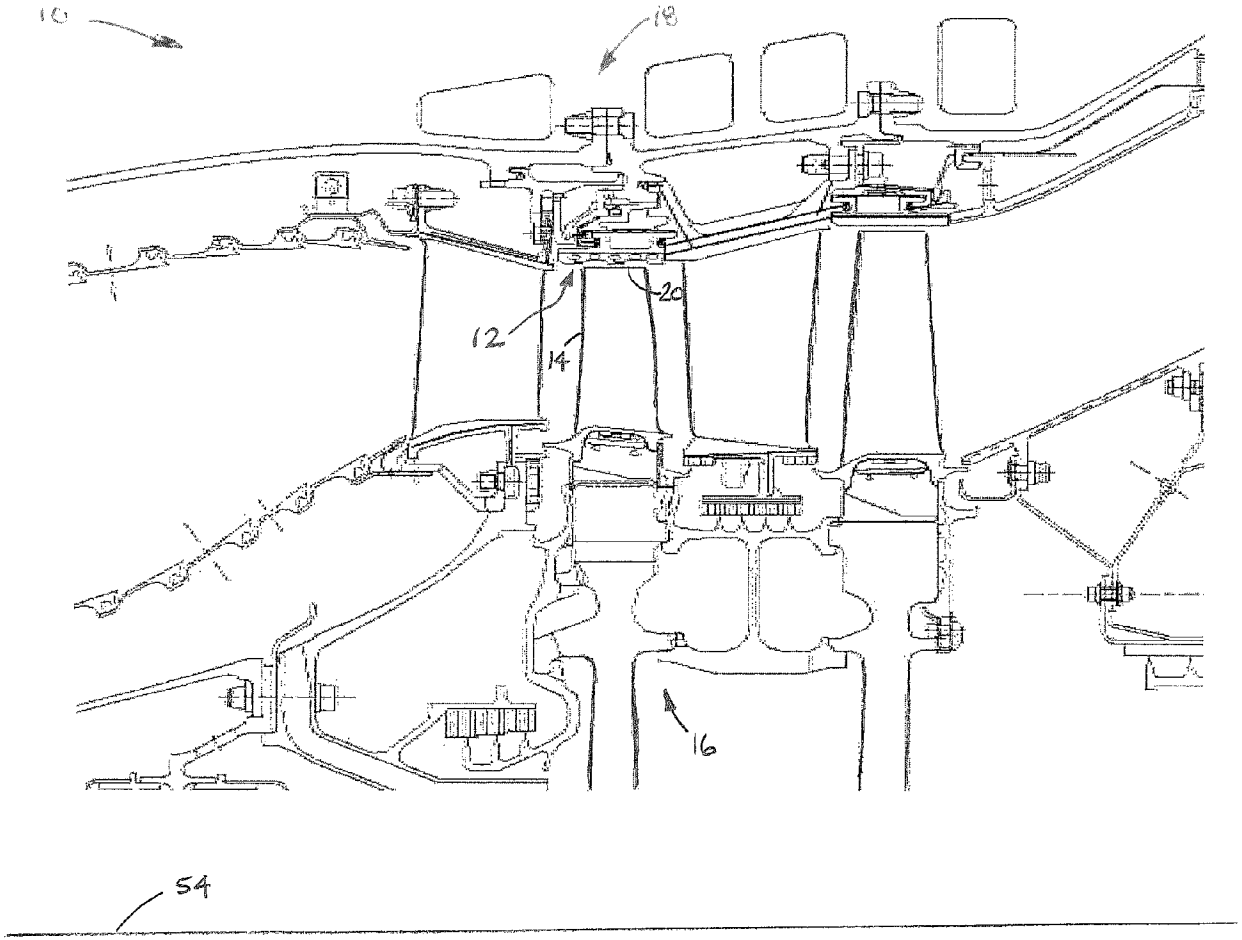
FIG. 1 is a side-sectional diagrammatic illustration of a section (e.g., a turbine section) of a gas turbine engine.

Referring to FIG. 1, a section of a gas turbine engine 10 includes a blade outer air seal 12 (hereinafter "BOAS") disposed between a plurality of circumferentially disposed rotor blades 14 of a rotor stage 16 and an annular outer engine case 18 (hereinafter "engine case"). In the present embodiment, the BOAS 12 includes a plurality of circumferentially extending segments and is adapted to limit air leakage between blade tips 20 and the engine case 18.

Figure 2:
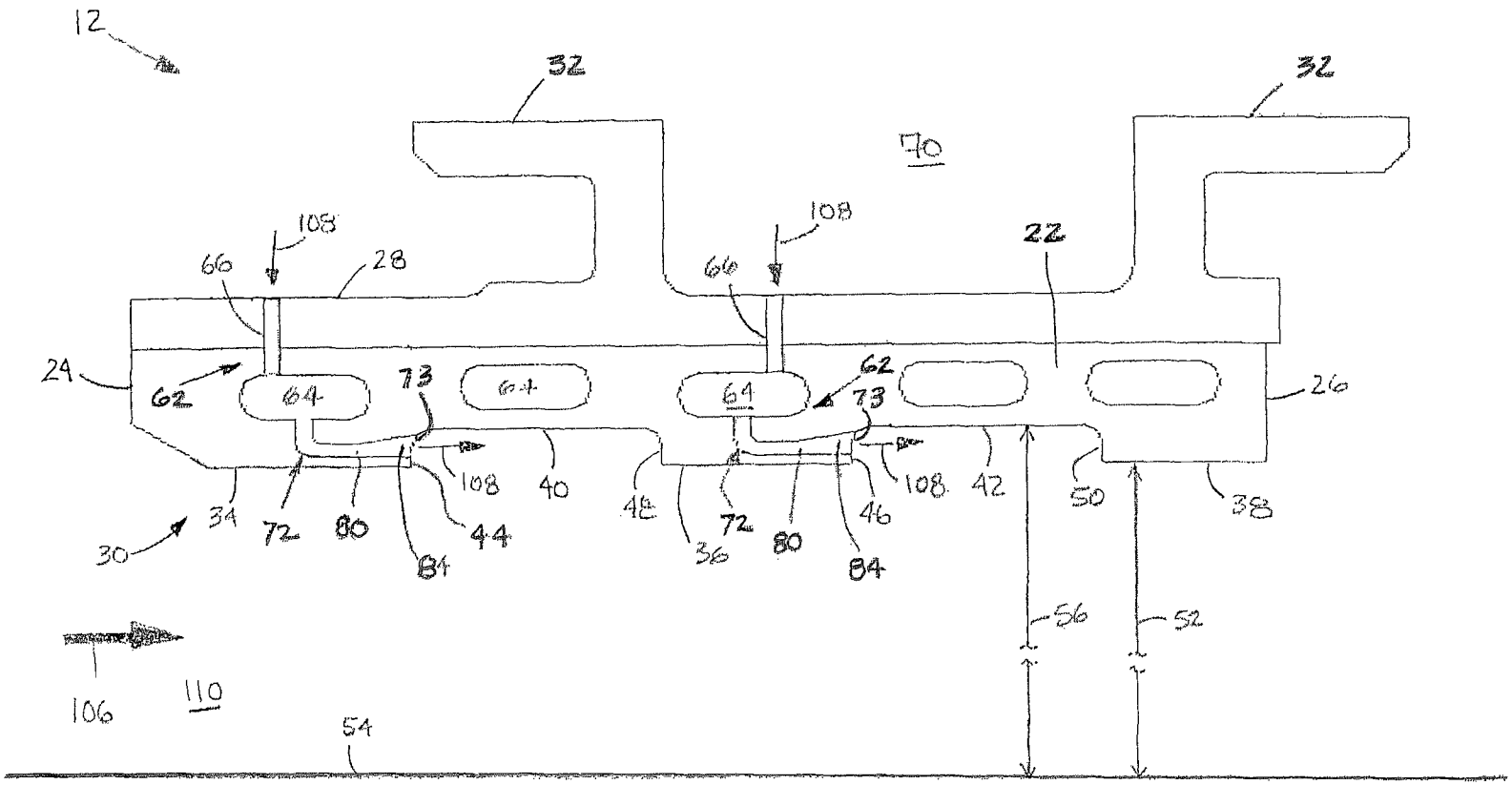
FIG. 2 is a side-sectional diagrammatic illustration of one embodiment of a blade outer air seal.
Figure 3:
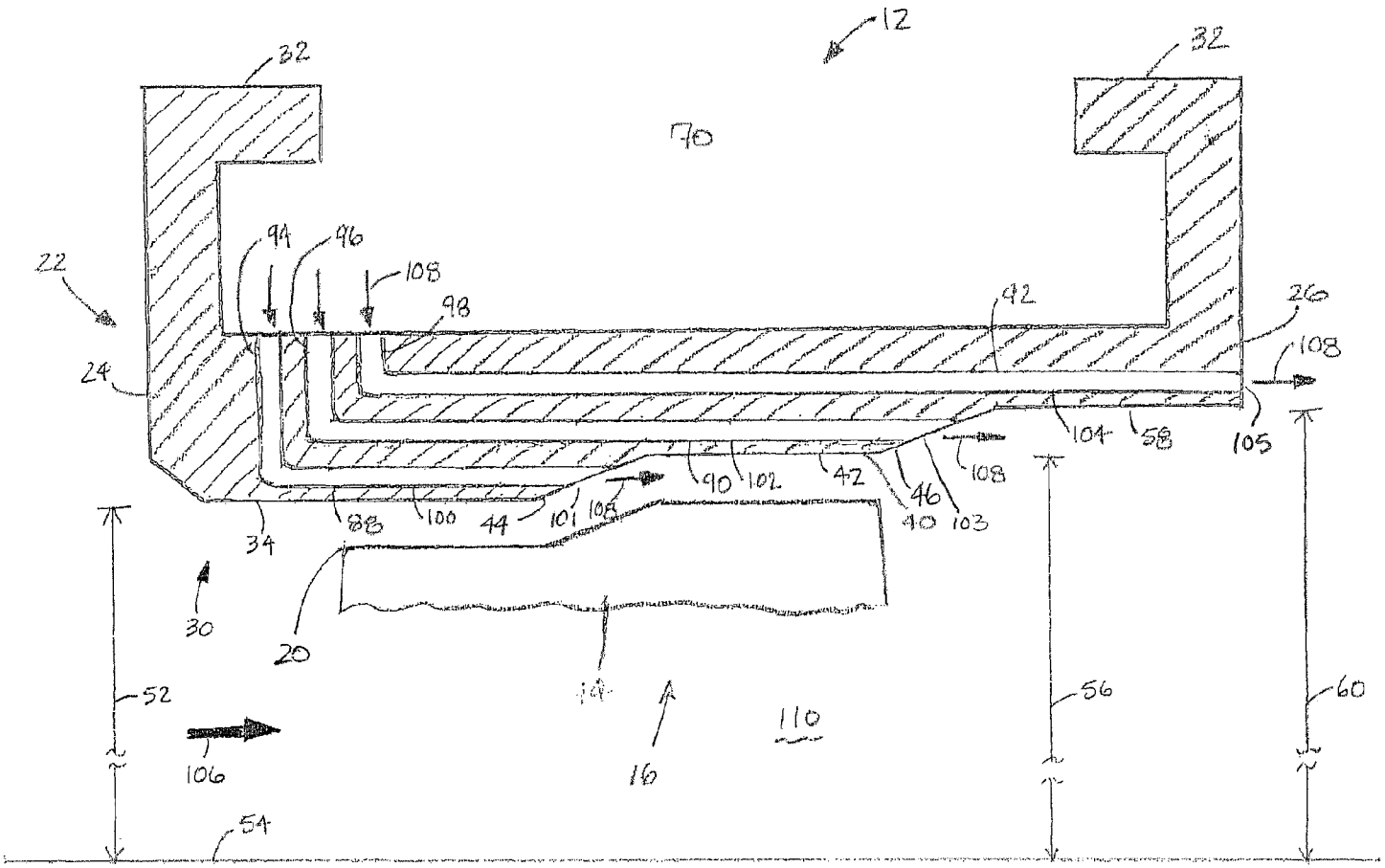
FIG. 3 is a side-sectional diagrammatic illustration of another embodiment of a blade outer air seal.

Referring to FIGS. 2 and 3, each segment of the BOAS 12 includes a body 22 that axially extends between a forward edge 24 and an aft edge 26, and radially extends between an outer radial surface 28 and an inner radial surface 30. When assembled, the BOAS inner radial surface 30 is disposed adjacent the rotor blade tips 20. One or more mounting features 32 (e.g., hooks, flanges, etc.) extend radially out from the outer radial surface 28 of each BOAS 12 for engagement with hardware connected to the engine case 18 (see FIG. 1). The BOAS 12 may be connected to the engine case 18 by a variety of different mounting configurations, and the present invention BOAS 12 is not limited to any particular mounting configuration.

Figure 4:
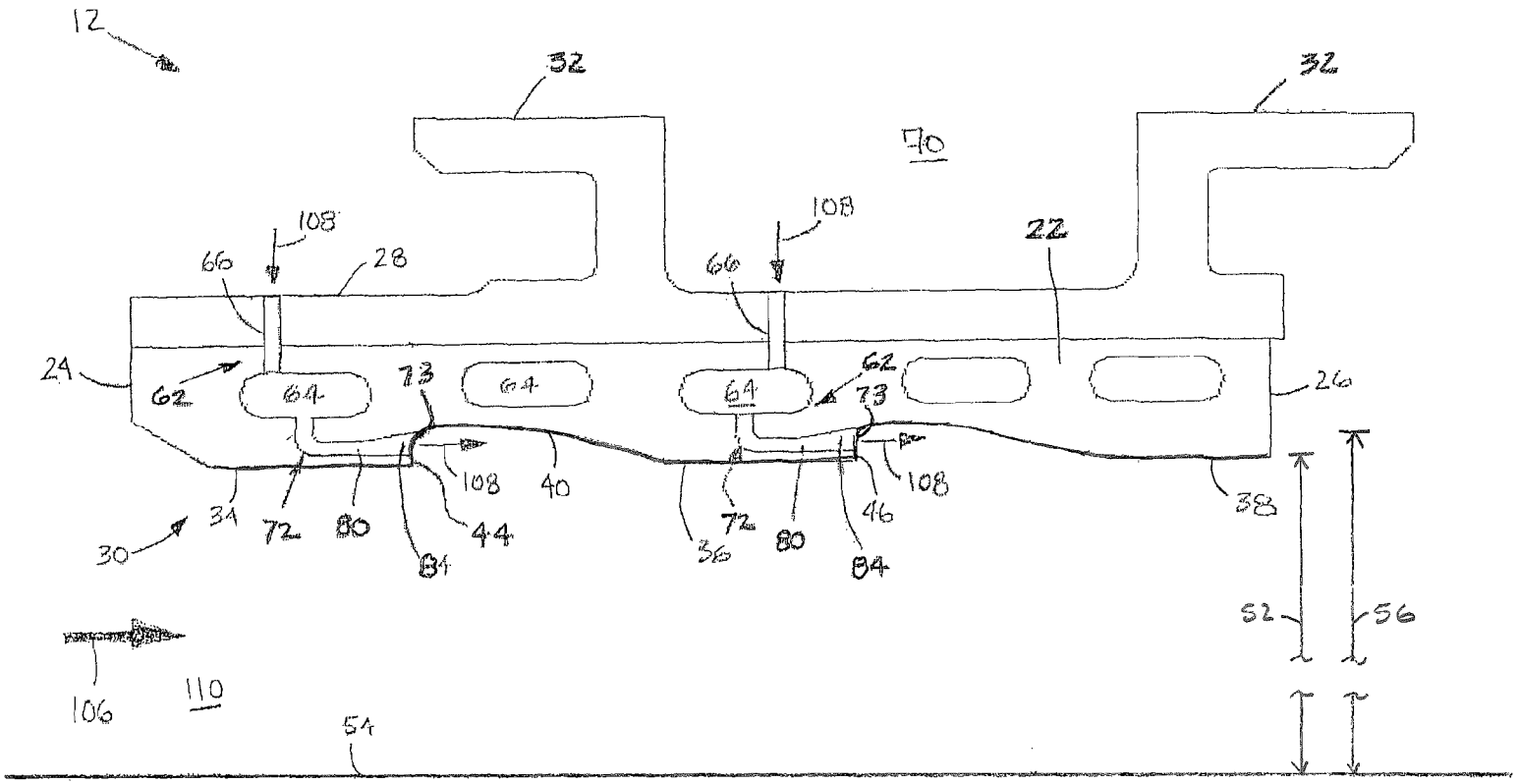
FIG. 4 is a side-sectional diagrammatic illustration of another embodiment of a blade outer air seal.

The BOAS inner radial surface 30 includes at least one first seal section 34, at least one second seal section 40, and at least one riser 44. When assembled, the first seal section 34 extends in a substantially axial direction and is located at a first radial distance 52 from a centerline 54 of the rotor stage 16 (see FIG. 1); i.e., it extends along a line that is substantially parallel to the centerline 54. Likewise when assembled, the second seal section 40 extends in a substantially axial direction, and is located at a second radial distance 56 from the centerline 54, substantially parallel to the centerline 54. The present invention, however, is not limited to this configuration. For example, referring to the embodiment in FIG. 4, the first and/or the second seal sections 34, 40 can be sloped. In this embodiment, the second radial distance 56 is measured from the centerline 54 to a forward end of the second seal section 40. Referring again to FIGS. 2 and 3, the second radial distance 56 is greater than the first radial distance 52. The riser 44 extends in a direction having a radial component, between the first seal section 34 and the second seal section 40.

In the embodiment shown in FIG. 2, the BOAS inner radial surface 30 includes three first seal sections 34, 36, 38, two second seal sections 40,42, two forward risers 44, 46, and two aft risers 48, 50. The forward and aft risers 44, 46, 48 and 50 are substantially radially extending with curved transitions extending between the respective riser 44, 46 and second seal surface 40, 42.

In the embodiment shown in FIG. 3, the BOAS inner radial surface 30 includes a first seal section 34, a first riser 44, a second seal section 40, a second riser 46, and a third seal section 58. The first and second seal sections 34, 40 axially extend at the first and second radial distances 52, 56, respectively, and the third seal section 58 extends axially at a third radial distance 60 that is greater than the first and the second radial distances 52, 56. The first riser 44 extends between first and second seal sections 34, 40. The second riser 46 extends between the second and third seal sections 42, 58.

The embodiments shown in FIGS. 2 and 3 are examples of the present invention BOAS 12. The present invention BOAS 12 is not limited to embodiments having these particular inner radial surface 30 configurations, and may alternatively include other configurations having a first seal section, a second seal section, and a riser disposed therebetween.

In the embodiment shown in FIG. 2, each segment of the BOAS 12 includes a plurality of cooling air apertures 62 extending between the outer radial surface 28 and the inner radial surface 30. In some embodiments, each segment of the BOAS 12 also includes one or more circumferentially extending cooling air passages 64 disposed within the body 22 of the segment. At least one of the circumferentially extending passages 64 is in fluid communication with some of the cooling air apertures 62. In those instances where a cooling air aperture 62 is in fluid communication with a circumferentially extending passage 64, the aperture 62 includes a first portion 66 and a second portion 72. Each first portion 66 extends from the outer radial surface 28 to the cooling air passage 64, thereby providing a cooling air path between the region 70 radially outside of the BOAS 12 and the internal cooling air passage 64. Each cooling air aperture second portion 72 extends from a cooling air passage 64 to a riser 44, 46. Each second portion 72 includes an exit 73 that is configured to direct cooling air substantially parallel to the respective second seal surface 40, 42. Each aperture second portion 72 typically includes an axial section 80 that extends within the body 22, in a direction substantially parallel to the second seal surface 40, 42. The axial section 80 provides internal convective cooling and facilitates axial alignment of the flow within the second portion 72, thereby facilitating cooling air film formation immediately downstream of the riser 44, 46. Each aperture second portion 72 may include a diffuser 84 proximate to the riser 44, 46 to further facilitate the formation of a film of cooling air along the second seal surface 40, 42. In some embodiments, the cooling air aperture first portions 66 are misaligned with the cooling air aperture second portions 72 within the passage 64. As a result, cooling air entering the passage 64 impinges on the wall of the passage 64 prior to entering the aperture second portion 72.

In the embodiment shown in FIG. 3, the BOAS 12 includes a plurality of first cooling air apertures 88, a plurality of second cooling air apertures 90, and a plurality of third cooling air apertures 92. Inlets 94 to the first cooling air apertures 88 are disposed forward of inlets 96 to the second cooling air apertures 90, and the inlets 96 to the second cooling air apertures 90 are disposed forward of inlets 98 to the third cooling air apertures 92. An axial portion 100 of each first cooling air aperture 88 extends within the body 22 substantially parallel to the first seal section 34 before exiting through a cooling aperture exit 101 disposed in the first riser 44 extending between the first seal section 34 and the second seal section 40. An axial portion 102 of each second cooling air aperture 90 extends within the BOAS body 22 substantially parallel to the second seal section 40 before exiting through a cooling aperture exit 103 disposed in the second riser 46. An axial portion 104 of each third film cooling apertures 92 extends within the BOAS body 22 substantially parallel to the third seal section 58 before exiting through a cooling aperture exit 105 disposed in the aft edge 26 of the BOAS 12. In the present embodiment, the cooling apertures 88, 90, 92 are arranged in a stacked or layered configuration such that at least portions of the axial portions 100, 102, 104 of cooling apertures are axially aligned; however, the present invention is not limited thereto.

In this embodiment, each of the rotor blades 14 can be configured having a blade tip geometry (e.g., a stepped geometry) that substantially mates with the geometry of the inner radial surface 30 of the BOAS 12. A mating tip geometry can reduce clearances between the rotor blades 14 and the BOAS 12, thereby reducing airflow leakage therebetween.

Referring to FIGS. 1-3, during operation of the engine 10, a pressure differential is generated between a leading edge and a trailing edge of the blade 14. Specifically, a region proximate the leading edge of the blade 14 has a higher pressure than a region proximate the trailing edge of the blade 14. Additionally, a pressure differential is generated between the outer and the inner radial surfaces 28, 30 of the BOAS 12. Specifically, cooling air is provided within the plenum 70 disposed radially outside of the BOAS 12 at a pressure higher than the pressure of the core gas flow 106 proximate either axial side of the rotor stage 16. The pressure differential forces the cooling air 108 through the apertures disposed within the BOAS 12 and into the core gas path 110.

In terms of the embodiment shown in FIG. 2, the cooling air 108 enters the cooling air aperture first portions 66 and impinges against the opposite wall of the passage 64, thereby providing impingement cooling. The cooling air 108 can flow circumferentially some amount within the respective cooling air passage 64 providing convective cooling and subsequently enter the cooling air aperture second portions 72. The cooling air 108 travels within the axial section 80 of each second portion 72, and provides convective cooling to the surrounding region of the BOAS 12 (e.g., the first seal section 34, 36, 38). During passage through the axial section 80, the cooling air flow 108 within the axial section 80 becomes increasingly less turbulent and more axially aligned. The cooling air 108 subsequently exits the diffuser 84 through a riser 44, 46 in a direction substantially parallel with, and in close proximity to, the respective second seal section 40, 42, thereby facilitating the formation of a film of cooling air 108 along the second seal surface 40, 42.

In terms of the embodiment shown in FIG. 3, cooling air 108 within the plenum 70 radially outside of the BOAS 12 enters the inlets 94, 96, 98 of the first, second and third film cooling apertures 88, 90, 92. The cooling air 108 traveling within the axial portion 100 of each first film cooling aperture 88 provides convective cooling to the first seal section 34. The cooling air exits the first film cooling apertures 88 through the first riser 44 to provide a film of cooling air parallel with, and in close proximity to, the second seal surface 42 in the manner described above. The cooling air traveling within the axial portion 102 of each second film cooling aperture 90 provides convective cooling to the portion of the BOAS body 22 proximate the axial portion 100 of the first film cooling apertures 88, as well as convective cooling to the second seal section 40. The cooling air 108 exits the second film cooling apertures 90 through the second riser 46 to provide a film of cooling air parallel with, and in close proximity to, the third seal surface 58. The cooling air 108 traveling within the axial portion 104 of each third film cooling aperture 92 provides convective cooling to the portion of the BOAS body 22 proximate the axial portion 92 of the second film cooling apertures 90, as well as convective cooling to the third seal section 58. The cooling air 108 exits the aft edge 26 of the BOAS 12. Notably, by exhausting the cooling air 108 proximate to the lower pressure region (i.e., proximate the trailing edge of the blade 14), the cooling air 108 can be subjected to higher heat transfer coefficients within the axial portions 100, 102, 104 of the cooling apertures 88, 90, 92, thereby increasing cooling to the BOAS 12.

In situations where the blade tips 20 rub against the inner radial surface 30 of the BOAS 12, shards of material can become dislodged from the blade 14 and/or the BOAS 12. Material from the blade 14 and/or the BOAS 12 can also be smeared onto the inner radial surface 30 of the BOAS 12. With prior art BOAS configurations, such dislodged and/or smeared material often engaged the BOAS and obstructed cooling apertures. With the present invention BOAS 12, however, this material is likely to travel past cooling air aperture exits 73, 101, 103, 105 without creating obstructions because the travel path of the debris is likely to be perpendicular to the cooling air aperture exits. Additionally, referring to FIG. 3, even where an inner set of cooling apertures (e.g., the first set 88) is obstructed due to blade tip rub, the remaining outer sets (e.g., the second set 90 and the third set 92) of cooling apertures can remain unobstructed.

While various embodiments of the present invention have been disclosed, it will be apparent to those of ordinary skill in the art that many more embodiments and implementations are possible within the scope of the invention. Accordingly, the present invention is not to be restricted except in light of the attached claims and their equivalents.

What is claimed is:

1. A blade outer air seal for a gas turbine engine including a plurality of rotor blades, the blade outer air seal comprising:

a body extending between a forward edge and an aft edge and circumferentially partially around a centerline, the body including:

an outer radial surface;

an inner radial surface including at least one first seal section, at least one second seal section, and a riser extending radially between the first seal section and the second seal section; and a plurality of cooling air apertures, wherein each cooling air aperture extends between the outer radial surface and the riser, and wherein each cooling air aperture has an exit configured to direct cooling air, substantially parallel to the second seal section of the inner radial surface, between the second seal section of the inner radial surface and the rotor blades and axially aligned with the rotor blades.

2. The blade outer air seal of claim 1, wherein the exit of at least one of the cooling air apertures includes a diffuser portion.

3. The blade outer air seal of claim 1, wherein the body includes at least one circumferentially extending passage in fluid communication with one or more of the cooling air apertures.

4. A blade outer air seal for a gas turbine engine, comprising:

a body extending between a forward edge and an aft edge, and including:

an outer radial surface;

an inner radial surface including at least one first seal section, at least one second seal section, and a riser extending radially between the first seal section and the second seal section; and a plurality of cooling air apertures, wherein each cooling air aperture extends between the outer radial surface and the riser, and wherein each cooling air aperture has an exit configured to direct cooling air substantially parallel to the second seal section of the inner radial surface;

wherein the body includes a plurality of first seal sections, a plurality of second seal sections, and a plurality of risers, and wherein each riser extends radially between one of the first seal sections and one of the second seal sections; and wherein cooling air apertures extend between the outer radial surface and each riser, and wherein the exit of each cooling air aperture is configured to direct cooling air substantially parallel to the respective second seal section of the inner radial surface.

5. A blade outer air seal for a gas turbine engine, comprising:

a body extending between a forward edge and an aft edge, and including:

an outer radial surface;

an inner radial surface including at least one first seal section, at least one second seal section, and a riser extending radially between the first seal section and the second seal section; and a plurality of cooling air apertures, wherein each cooling air aperture extends between the outer radial surface and the riser, and wherein each cooling air aperture has an exit configured to direct cooling air substantially parallel to the second seal section of the inner radial surface;

wherein the inner radial surface further includes a second riser extending radially between the second seal section and a third seal section; and wherein the body further includes a plurality of second cooling air apertures, wherein each second cooling air aperture extends between the outer radial surface and the second riser, and wherein each second cooling air aperture has an exit configured to direct cooling air substantially parallel to the third seal section of the inner radial surface.

6. The blade outer air seal of claim 5, wherein the body further includes a plurality of third cooling air apertures that extend between the outer radial surface and the aft edge of the body.

7. The blade outer air seal of claim 5, wherein at least portions of the cooling air apertures and the second cooling air apertures are axially aligned in a stacked configuration.

8. A gas turbine engine, comprising:

an engine case;

a rotor stage having a plurality of blades; and a blade outer air seal disposed between the engine case and the blades, which blade outer air seal comprises a body that extends between a forward edge and an aft edge and circumferentially partially around a centerline, and which body includes:

an outer radial surface;

an inner radial surface that has at least one first seal section, at least one second seal section, and a riser extending radially between the first seal section and the second seal section; and a plurality of cooling air apertures, wherein each cooling air aperture extends between the outer radial surface and the riser, and wherein each cooling air aperture has an exit configured to direct cooling air, substantially parallel to the second seal section of the inner radial surface, between the second seal section of the inner radial surface and the blades and axially aligned with the blades.

9. The engine of claim 8, wherein the exit of at least one of the cooling air apertures includes a diffuser portion.

10. The engine of claim 8, wherein the body includes at least one circumferentially extending passage in fluid communication with one or more of the cooling air apertures.

11. The engine of claim 8, wherein the blades have a tip geometry that substantially mates with a geometry of the inner radial surface of the blade outer air seal body.

12. A gas turbine engine, comprising:

an engine case;

a rotor stage having a plurality of blades; and a blade outer air seal disposed between the engine case and the blades, which blade outer air seal comprises a body that extends between a forward edge and an aft edge, and includes:

an outer radial surface;

an inner radial surface that has at least one first seal section, at least one second seal section, and a riser extending radially between the first seal section and the second seal section; and a plurality of cooling air apertures, wherein each cooling air aperture extends between the outer radial surface and the riser, and wherein each cooling air aperture has an exit configured to direct cooling air substantially parallel to the second seal section of the inner radial surface;

wherein the body includes a plurality of first seal sections, a plurality of second seal sections, and a plurality of risers, and wherein each riser extends radially between one of the first seal sections and one of the second seal sections; and wherein cooling air apertures extend between the outer radial surface and each riser, and wherein the exit of each cooling air aperture is configured to direct cooling air substantially parallel to the respective second seal section of the inner radial surface.

13. A gas turbine engine, comprising:

an engine case;

a rotor stage having a plurality of blades; and a blade outer air seal disposed between the engine case and the blades, which blade outer air seal comprises a body that extends between a forward edge and an aft edge, and includes:

an outer radial surface;

an inner radial surface that has at least one first seal section, at least one second seal section, and a riser extending radially between the first seal section and the second seal section; and a plurality of cooling air apertures, wherein each cooling air aperture extends between the outer radial surface and the riser, and wherein each cooling air aperture has an exit configured to direct cooling air substantially parallel to the second seal section of the inner radial surface;

wherein the inner radial surface further includes a second riser extending radially between the second seal section and a third seal section; and wherein the body further includes a plurality of second cooling air apertures, wherein each second cooling air aperture extends between the outer radial surface and the second riser, and wherein each second cooling air aperture has an exit configured to direct cooling air substantially parallel to the third seal section of the inner radial surface.

14. The engine of claim 13, wherein the body further includes a plurality of third cooling air apertures that extend between the outer radial surface and the aft edge of the body.

15. The engine of claim 13, wherein at least portions of the cooling air apertures and the second cooling air apertures are axially aligned in a stacked configuration.

* * * * *